US006119961A

United States Patent [19]

Brown et al.

[11] Patent Number: 6,119,961

[45] Date of Patent: Sep. 19, 2000

[54] ASPHALT STRAINER FOR AN ASPHALT DISTRIBUTOR

[75] Inventors: Thomas R. Brown, Oregon; Jeremey Heller, Dixon; Patrick O'Brien, Oregon, all of Ill.

[73] Assignee: E. D. Etnyre & Co., Oregon, Ill.

[21] Appl. No.: 09/255,672

[22] Filed: Feb. 23, 1999

[51] Int. Cl.[7] ..... B05B 15/02; B05B 9/00

[52] U.S. Cl. ..... 239/106; 239/127

[58] Field of Search ..... 239/119, 106, 239/127, 575, 590, 590.3; 210/767, 805, 167, 194, 196, 197

[56] References Cited

U.S. PATENT DOCUMENTS

| | | | |
|---|---|---|---|
| 1,778,551 | 10/1930 | Etnyre . | |
| 2,011,894 | 8/1935 | Etnyre | 299/34 |
| 2,046,373 | 7/1936 | Etnyre | 299/34 |
| 2,123,156 | 7/1938 | Jagoe | 239/119 |
| 2,372,065 | 3/1945 | Etnyre | 299/34 |
| 2,472,199 | 6/1949 | Etnyre | 299/34 |
| 2,505,390 | 4/1950 | Etnyre | 299/34 |
| 2,571,850 | 10/1951 | Etnyre | 299/34 |
| 2,599,704 | 6/1952 | Etnyre | 299/34 |
| 3,239,148 | 3/1966 | Etnyre | 239/159 |
| 3,726,402 | 4/1973 | Goutos | 210/107 |
| 3,838,817 | 10/1974 | Hill | 239/125 |
| 4,274,586 | 6/1981 | Hill | 239/125 |
| 4,817,870 | 4/1989 | Dalton | 239/157 |
| 4,960,242 | 10/1990 | Larson | 239/168 |

*Primary Examiner*—Andres Kashnikow
*Assistant Examiner*—Davis Hwu
*Attorney, Agent, or Firm*—Leydig, Voit & Mayer

[57] ABSTRACT

In an asphalt distributor having a tank for holding asphalt and a pump for pumping asphalt from the tank to a spraybar, a self draining asphalt strainer is provided. The asphalt strainer includes a body having an inlet and outlet with a filtering chamber disposed between the inlet and the outlet. A filter or straining element is disposed in the filtering chamber for filtering asphalt flowing between the inlet and the outlet. A conduit extends the inlet into the filtering chamber. A pair of valves are disposed on each end of the conduit forming a suckback chamber therebetween. A suckback tube is connected to the conduit intermediate the valves and extends into the filtering chamber. The pump is bidirectional and has a reverse mode which forces asphalt back through the outlet and inlet into the tank. The strainer has a first flow passage from the outlet to the inlet through both of the valves when open. The suckback tube provides a second flow passage from the outlet to the inlet when one of the valves is closed for draining asphalt remaining in the strainer box.

23 Claims, 6 Drawing Sheets

ASPHALT STRAINER FOR AN ASPHALT DISTRIBUTOR

FIELD OF THE INVENTION

The present invention generally relates to asphalt distributors and more particularly relates to asphalt strainers in asphalt distributors.

BACKGROUND OF THE INVENTION

Hot liquid asphalt is applied to road and other surfaces in a variety of paving applications. Upon cooling, asphalt material becomes more viscous and eventually "freeze". Hot asphalt is typically applied by vehicular spraying apparatuses commonly known as asphalt distributors. Asphalt distributors conventionally comprise a pump delivering hot liquid asphalt from tank to a spray bar. The tank, pump and spraybar may either be supported by a truck or pulled behind the truck as a detachable trailer.

Before asphalt distributors can be stored, residual asphalt remaining in the spray bar and associated plumbing network must be removed to prevent asphalt from freezing therein, which could otherwise plug the distributor during the next startup. An older more traditional method of removing the remaining asphalt is to flush the asphalt out of the network and spray bar with a suitable solvent, such as diesel or flushing oil for example. However, this method has the drawbacks of requiring a large quantity of solvent and wasting the asphalt remaining in the network and spray bar. This method also creates a large quantity of asphalt-solvent waste product which must be disposed of in an environmentally sound manner, which is also costly.

To reduce the amount of asphalt remaining in the network and the amount of solvent needed to flush the distributor, many asphalt distributors have a bidirectional pump which can operate in reverse or "suckback mode" to suck asphalt from the network and spray bar back into the tank. After much of the asphalt is sucked back, the distributor is then typically flushed with solvent to remove any remaining asphalt in the network and spray bar. Although the "suckback mode" reduces the quantity of asphalt remaining in the distributor, significant quantities of asphalt still remain in various low collection points or sumps in the network after suckback mode. To prevent asphalt from freezing in these low points, significant quantities of flushing solvent is conventionally used to remove the remaining asphalt from these low collection points. However, using significant quantities of solvent is undesirable for the reasons outlined above and for space and convenience reasons. One significant and problematic low collection point is in the asphalt strainers of asphalt distributors. Asphalt strainers are typically connected between the tank and the pump of the distributor for removing frozen chunks of asphalt and other large impurities from the asphalt during spraying and other operations to ensure smooth operation of the distributor and to prevent clogging of nozzles in the spray bar. Due to the conventional large box like structure of prior asphalt strainers, a low point or sump is inherent therein.

SUMMARY OF THE INVENTION

It is therefore the general aim of the present invention to reduce the amount of asphalt remaining in the strainer of an asphalt distributor after asphalt suckback operation.

It is an object of the present invention to drain asphalt remaining in the low points of the asphalt strainer in an asphalt distributor.

It is another object according to a specific embodiment to provide a mechanism internal to an asphalt strainer that drains the low points therein in an environmentally sound manner.

It is another object of the present invention to accomplish these aims and objects in a cost prudent manner.

In accordance with these aims and objectives, the present invention is directed toward an asphalt strainer having a suckback tube for draining asphalt remaining in the filtering chamber of the strainer during suckback mode. The training includes a body having an inlet and an outlet with the filtering chamber therebetween. A straining element is disposed in the filtering chamber for filtering asphalt flowing between the inlet and the outlet. A valve is connected to the inlet and has open and closed positions for correspondingly connecting and disconnecting the inlet to the filtering chamber. The suckback tube is connected to the inlet and extends into the filtering chamber to provide a flow passage from the filtering chamber to the inlet when the valve is closed.

It is a feature of the present invention to provide a self draining asphalt strainer in an asphalt distributor. The asphalt strainer comprises a body having an inlet, an outlet and a filtering chamber therebetween. The inlet is in fluid communication with the tank of the asphalt distributor while the outlet is in fluid communication with the bidirectional pump of the asphalt distributor. The inlet is disposed vertically above the outlet. A straining element is disposed in the filtering chamber for filtering asphalt flowing between the inlet and the outlet. The strainer includes a conduit extending the inlet into the filtering chamber. The conduit has a first end connected to the body and a second end that opens into the filtering chamber. Between the first and second ends the conduit defines a suckback chamber. A pair of open and closed valves are provided, one on each end of the conduit. When both valves are open, a first flow passage is formed from the outlet to the inlet. A suckback tube is connected to the conduit intermediate the valves to provide a second flow passage from the filtering chamber to the suckback chamber. When the valve at the open end of the conduit is closed, the suckback tube is operable to drain asphalt remaining in the filtering chamber during suckback mode.

It is an advantage that the suckback tube is completely internal to the strainer body. This prevents asphalt from freezing in the suckback tube and also prevents potential for unnecessary leaks.

It is an aspect of the present invention that the preferred embodiment provides a single control for controlling the positions of both valve members. According to the preferred embodiment, the single control includes a linearly translatable drive shaft that slidably carries the valve members. The shaft has a pair of radially outward extending members which engage the valves to position them relative to the body. The position of the shaft can be controlled by a single manually positioned wheel or crank.

It is another feature of the present invention to provide an improved method of draining residual asphalt remaining in the strainer of an asphalt distributor during suckback mode. The method comprises the steps of operating the pump in reverse to direct asphalt through the strainer along a first flow passage from the outlet to the inlet. After substantially all of the asphalt is removed from the spraybar and associated network of the asphalt distributor, the first flow passage is closed. Asphalt remaining in the strainer is then drained through a suckback tube internal to the strainer. The suckback tube provides a second flow passage from the filtering chamber to the inlet.

These and other objects and advantages of the invention will become more apparent from the following detailed description when taken in conjunction with the accompanying drawings.

Figure 1:
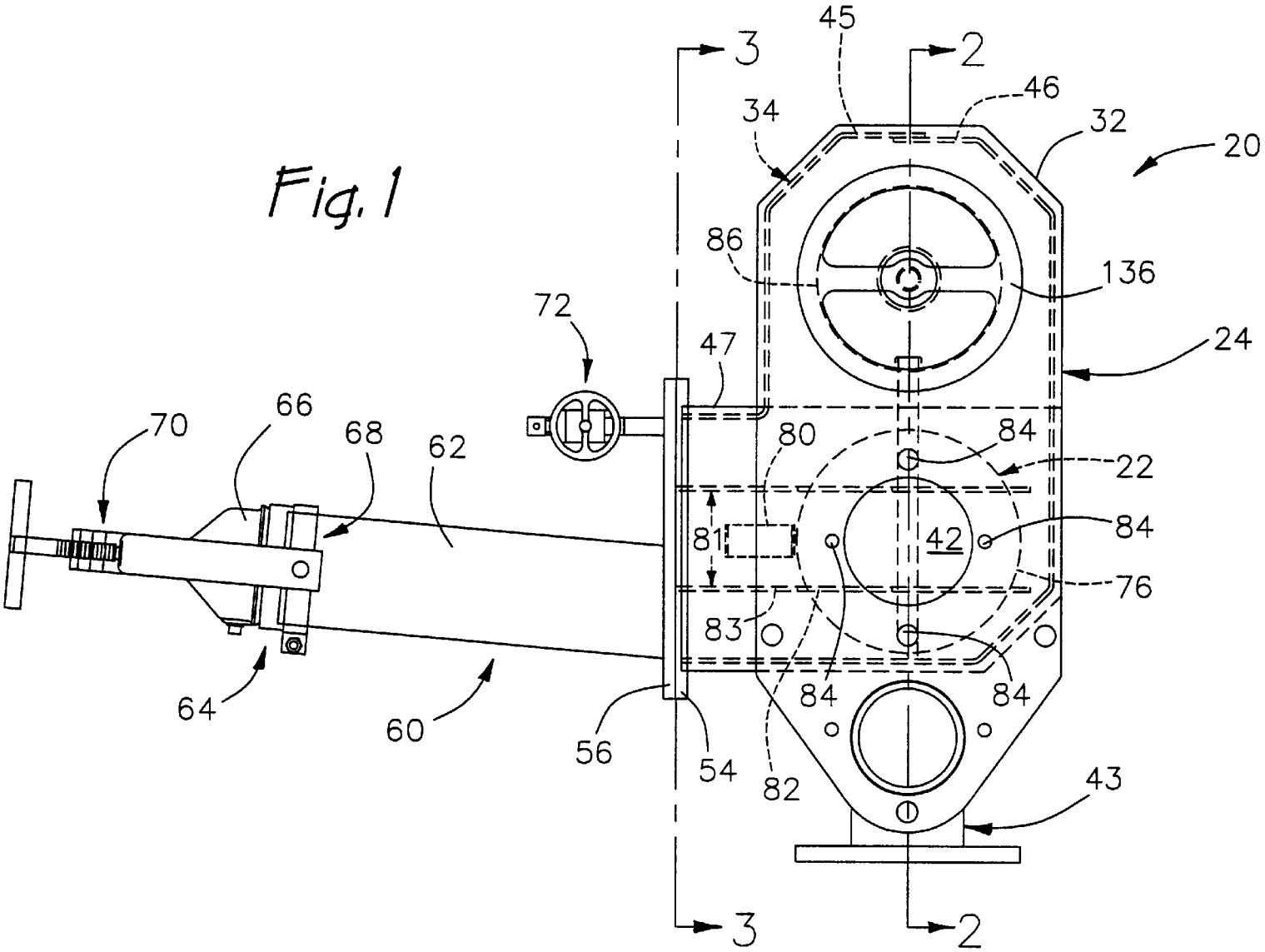
FIG. 1 is a side view of an asphalt strainer according to a preferred embodiment of the present invention with hidden lines showing some of the internal components of the strainer.

While the invention is susceptible of various modifications and alternative constructions, a certain illustrative embodiment thereof has been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Figure 2:
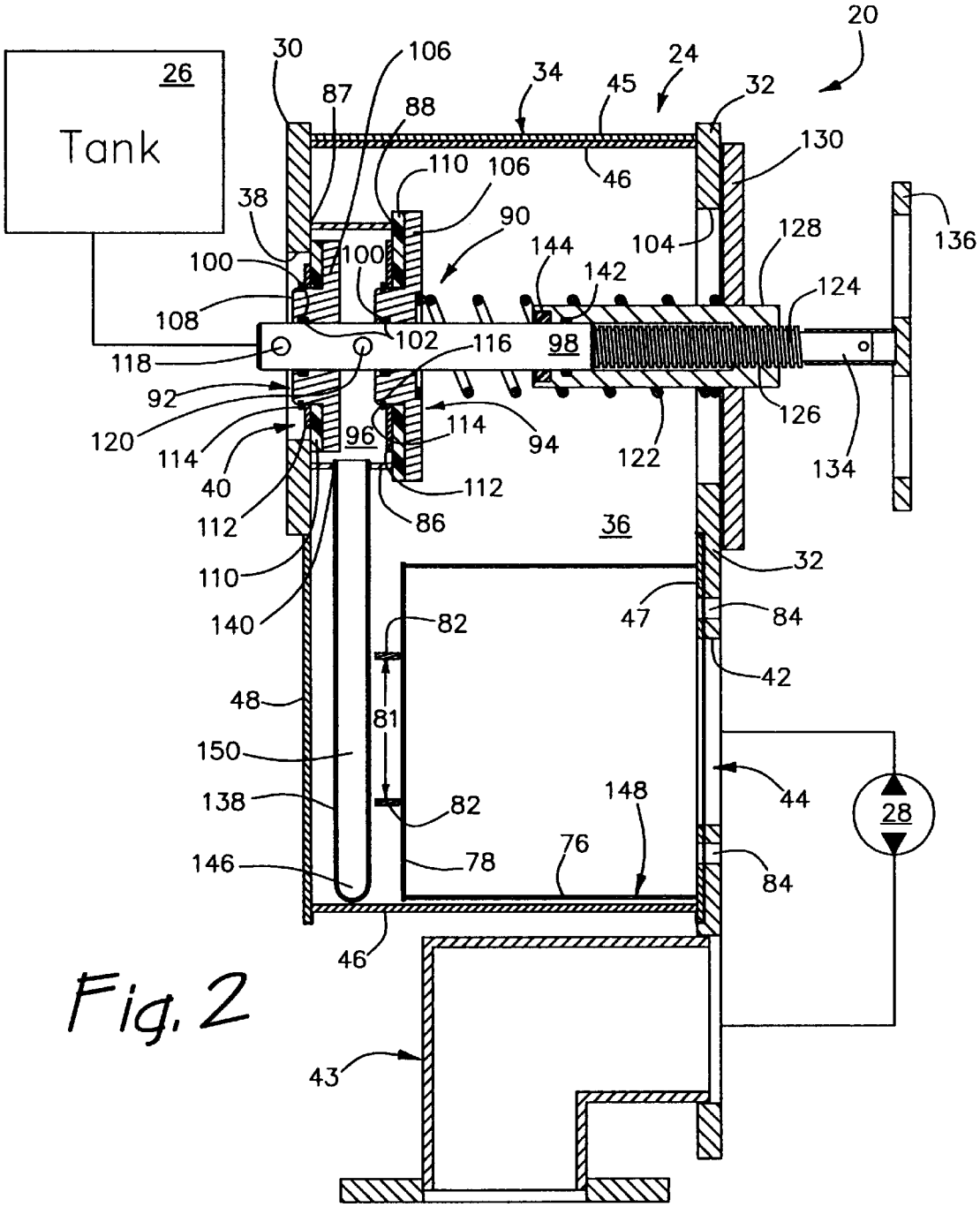
FIG. 2 is a cross-sectional view of FIG. 1 taken about line 2—2.

For purposes of illustration and referring to FIGS. 1 and 2, an asphalt strainer 20 having an internal drainage mechanism according to a preferred embodiment of the present invention is illustrated for use in a circulation system of a vehicular asphalt distributor. The strainer 20 includes a screening element 22 disposed in a strainer box or body 24 for filtering asphalt flowing between a tank 26 and a bidirectional pump 28 of the asphalt distributor, the tank and pump being schematically illustrated in FIG. 2. The pump 28 has forward mode for pumping asphalt from the tank 26 to a spray bar (not shown) and reverse mode for sucking asphalt from the spray bar back to the tank 26.

Figure 3:
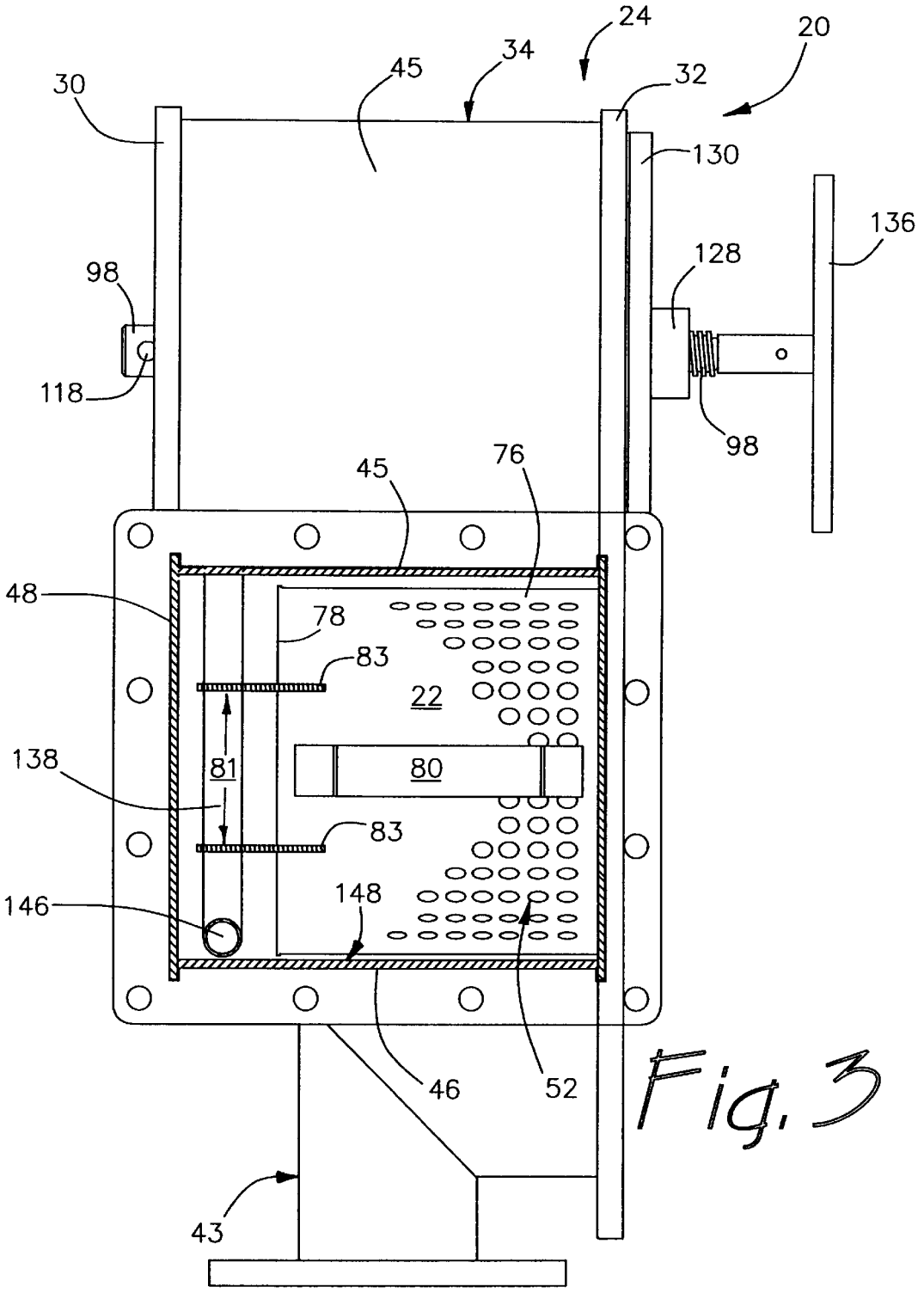
FIG. 3 is a cross-sectional view of FIG. 1 taken about line 3—3.
Figure 4:
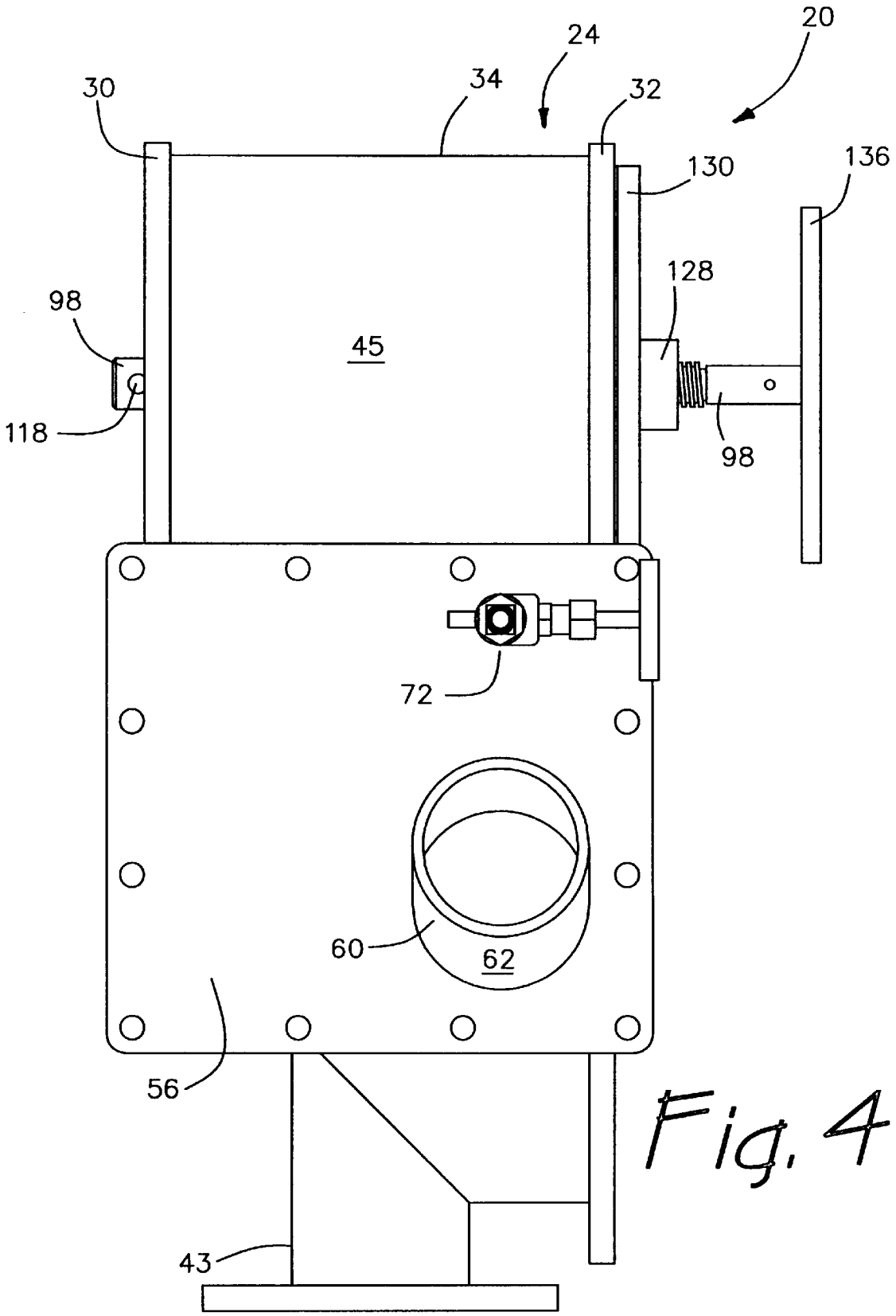
FIG. 4 is a side view of FIG. 1

Referring to FIG. 2 of the preferred embodiment, the strainer body 24 includes two parallel and horizontally spaced inlet and outlet mounting flanges 30, 32 connected by an outer sidewall 34 to provide a sealed relatively large enclosed space or filtering chamber 36. The inlet mounting flange 30 defines an inlet orifice 38 to provide for an inlet 40 in fluid communication with the tank 26. The outlet mounting flange 32 defines an outlet orifice 42 to provide for an outlet 44 in fluid communication with the pump 28. Preferably, the pump 28 mounts directly on the outlet mounting flange 32 and an output pipe assembly 43 is connected to the output mounting flange 32 for receiving the pump output and communicating pumped asphalt to downstream control valves (not shown) and spraybar (not shown). As shown and oriented in the Figures, the inlet 40 is disposed vertically above the outlet 44. In the preferred embodiment, the sidewall 34 includes several individual side panels 45, 46, 47, 48 formed from relatively heavy gage sheet steel that are welded or otherwise joined together and that are welded or otherwise joined to the flanges 30, 32 to form the filtering chamber 36. Referring now to FIG. 3, the side panels 45–48 also meet to define a generally rectangular opening 52. At the rectangular opening 52, a generally rectangular strip or input mounting flange 54 is closely fitted orthogonally over sides 45–48 and joined thereto by welding or other acceptable means. As shown best in FIGS. 1 and 3, the input mounting flange 54 lies is a plane generally perpendicular to the inlet and outlet mounting flanges 30, 32. The input mounting flange 54 defines threaded holes which are aligned with corresponding holes of a lid 56 (FIG. 4). The lid 56 is selectively fastened by screws or other suitable fasteners to the input mounting flange 54 to generally close and seal the opening 52 and filtering chamber 36.

Referring now to FIGS. 1 and 4, the lid 56 provides for a tank loading input generally indicated at 60. In the preferred embodiment, the tank loading input 60 includes a input pipe 62 welded or otherwise joined to the lid 56 that extends outward and vertically upward at an angle so as not to form a sump which could collect asphalt. The tank loading input 60 also includes a quick disconnect coupling 64 which includes a cap or plug 66 sealingly received into an open end 68 of the input pipe 62 and a clamping assembly 70 that selectively tightens the plug 66 against the walls of the pipe 62 to selectively seal off the pipe 62 and filtering chamber 36 from the outside. The input pipe 62 can selectively be connected to external supply lines for tank filling operation, with the pump 28 pumping asphalt back into the tank through a return line (not shown) downstream of the strainer 20 and pump 28. The lid 56 also includes a hose barb and valve assembly 72 for connection to an external source of flushing solvent such as diesel for flushing any asphalt remaining in the system.

Referring to FIG. 3, the filter or screening element 22 is housed in the filtering chamber 36 and closely covers the outlet orifice 42 (FIG. 2) for preventing large asphalt chunks or other impurities from interfering with the smooth operation of the distributor . In the preferred embodiment, the screening element 22 comprises a perforated sidewall 76 formed into a cylinder or tube, and a circular perforated plate 78 welded otherwise joined to one of the open ends of the perforated sidewall 76. The screening element 22 also preferably includes a handle joined to the sidewall 76. The handle 80 extends radially outward from the sidewall 76 to provide for easily manipulation of the screening element 22. By removing the lid 56 (FIG. 4), the screening element 22 can be removed for cleaning or replacement. To keep the screening element 22 in place, the lid 56 includes a pair of prongs 81 which cradle the screening element 22 prevent axial and lateral movement thereof. More specifically, each prong includes a narrow portion 82 (FIGS. 1 and 2) that engages the perforated plate 78 to prevent axial movement of the screening element 22 and a wider portion 83 (FIGS. 1 and 3) that engages the perforated sidewall 76 to limit lateral movement of the screening element 22. The fastening screws (not shown) which fasten the pump 28 to the outlet flange 32 fit through holes 84 (FIGS. 1 and 2) in the outlet mounting flange 32 and project into the inside of the screening element 22 in close proximity to the perforated sidewall 76 to further limit lateral movement of the screening element 22.

Referring again to FIG. 2, the inlet 40 is extended into the filtering chamber 36 by a cylindrical mounting tube 86 or other conduit that is disposed in the filtering chamber 36. The mounting tube 86 is fluidically connected to the inlet orifice 38 and has a first end 87 welded or otherwise joined to the inlet mounting flange 30. As seen, the diameter of the inlet orifice 38 is less than the inner diameter of the mounting tube 86. The other end 88 of the mounting tube 86 opens into the filtering chamber 36.

To control the flow of asphalt through the inlet 40 and mounting tube 86, the preferred embodiment includes an valve assembly generally indicated at 90. The valve assembly 90 includes a first smaller annular valve member 92 for opening and closing the inlet orifice 38 and a second larger annular valve member 94 for opening and closing the open end 88 of the mounting tube 86. Between the valve members 92, 94, the mounting tube 86 provides an intermediate suckback chamber 96.

Referring in greater detail to the inlet valve assembly 90 of the preferred embodiment as detailed in FIG. 2, the larger and smaller annular valve members 92, 94 are slidably carried on a linearly translatable shaft 98, preferably in a coaxial fashion. Each valve member 92, 94 has an inner groove 100 carrying an inner ring gasket 102 for preventing asphalt seepage between the respective valve members 92, 94 and the shaft 98. The shaft 98 extends transversely from inlet orifice 38 through the mounting tube 86, the filtering chamber 36 and a large aperture 104 in the outlet mounting flange 32 and projects horizontally outside the strainer body 24. The smaller valve member 92 is disposed inside the mounting tube 86 and has an annular plate portion 106 for sealingly engaging the inlet mounting flange 30 and an axially projecting plug portion 108 extending into the inlet orifice 38. The larger valve member 94 is disposed in the filtering chamber 36 and similarly has a plate portion 106 for sealingly engaging the open edge 88 of the mounting tube 86 and an axially projecting plug portion 108 extending into the mounting tube 86. To prevent leakage between the valve members and their respective ports while in the closed position, each of the valve members 92, 94 includes a resilient disc shaped gasket 110 that is seated against the plate portion 106. The disc gasket 110 is held in place by a rigid disc or washer 112 and a retainer ring 114 held in a corresponding outer annular periphery groove 116 in the plug portion 108.

Figure 2A:
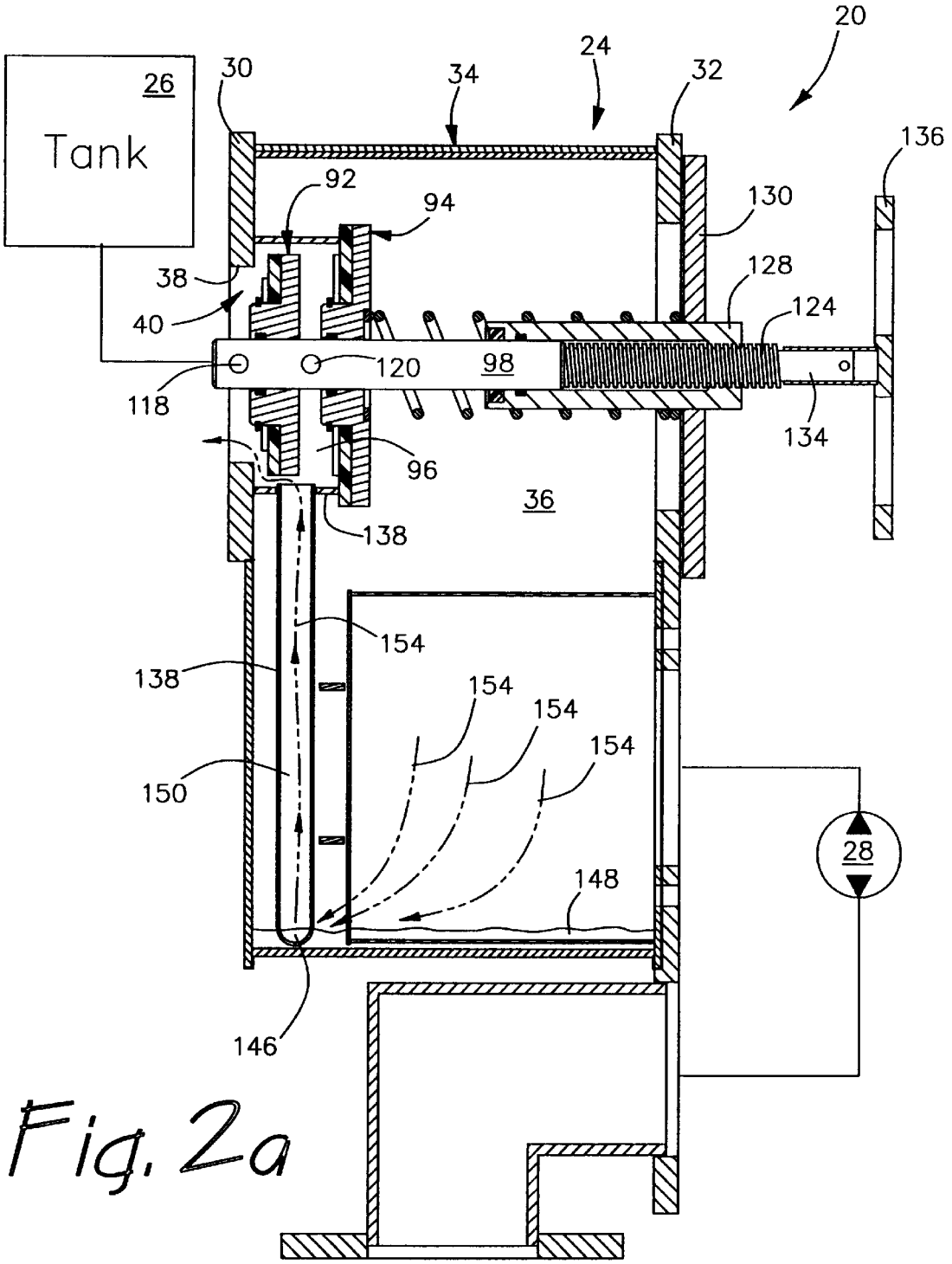
FIG. 2*a* is the same view of FIG. 2 but with the valve assembly in a first alternate position.

To control the positions of the valves 92, 94, a pair of spring pins 118, 120 or other radially extending members are connected to the shaft 98. The spring pins 118, 120 are axially spaced with one spring pin on each side of the smaller valve member 92. The spring pins 118, 120 extend radially outward for engaging the valve members 92, 94 over various ranges of shaft 98 translation. More specifically, as shown and oriented in FIG. 2, the shaft has a position in which the right spring pin 120 is engaging the smaller valve member 92 keeping it in the closed position. A spring 122 or other resilient means, coaxially disposed over the shaft 98 urges the larger valve member 94 against the mounting tube 86, preventing asphalt flow therethrough. As the shaft 98 is translated to the left, the left spring pin 118 will engage the smaller valve member 92 lifting it off of the inlet mounting flange 30 and opening the suckback chamber 96 to the tank 26, as is shown in FIG. 2*a*. As the shaft 98 is further translated to the position shown in FIG. 2*b*, the right spring pin 120 engages the larger valve member 94 lifting it off of the mounting tube 86, compressing the spring 122 and opening the filtering chamber 36 to the tank 26.

To control the position of the shaft 98, the shaft 98 includes a threaded portion 124 that screwed into corresponding threads 126 of a fixed sleeve 128. The sleeve 126 is fixed to a plate portion 130 which in turn is securely fastened to the outside of the outlet mounting flange 32 to cover the aperture 104. The outer end 134 of the shaft 98 is coupled to the axis or hub of a manually driven wheel crank 136. The combination of the wheel crank 136 and the shaft 98 provide for a single control mechanism for controlling the positions of both valve members 92, 94. Rotation of the wheel 136 causes the shaft 98 to linearly translate. To ensure smooth translation of the shaft 98 and prevent leakage, the sleeve 126 carries a inner ring gasket 142 and a scraper 144. It is an advantage of the valve members that the valve members 92, 94 can be controlled by a single control, thereby keeping cost and complexity to a minimum. Although the single control means is provided by a linearly removable shaft and wheel, an alternative embodiment may include a three position pneumatic cylinder or other actuator for translating the shaft 98 or selectively positioning the valve members 92, 94. Such a pneumatic cylinder or other appropriate actuator has the advantage of remote control as from a truck cab.

In accordance with the objective of draining asphalt remaining in the low points of the asphalt strainer in an asphalt distributor, the preferred embodiment includes a suckback tube 138 for draining the low points or sumps of the filtering chamber 36. The suckback tube 138 is securely connected into a hole 140 in the mounting tube 86 for fluid communication with the suckback chamber 96 and projects vertically downward into the filtering chamber 36 to provide an open end 146 which is in close proximity to the gravitational inner bottom surface 148 of the strainer body 24. By locating the open end 146 of the suckback tube 138 in close proximity to the bottom surface 148, the preferred embodiment advantageously drains substantially all of the asphalt remaining in the filtering chamber 36 during suckback mode. The suckback tube 138 bypasses the larger valve member 94 providing a dedicated flow passage 150 between the suckback chamber 96 and the filtering chamber 36. As shown, the suckback tube 138 is preferably sized several times smaller than the openings provided by the valves 92, 94 when in fully open positions so that the tube 138 primarily functions as an internal drainage device without unduly increasing the size of the strainer 20. An advantage of the preferred embodiment is that the suckback tube 138 is disposed entirely within the body 24 and filtering chamber 36 so that asphalt does not freeze in the tube 138 during normal spraying operations.

Figure 2B:
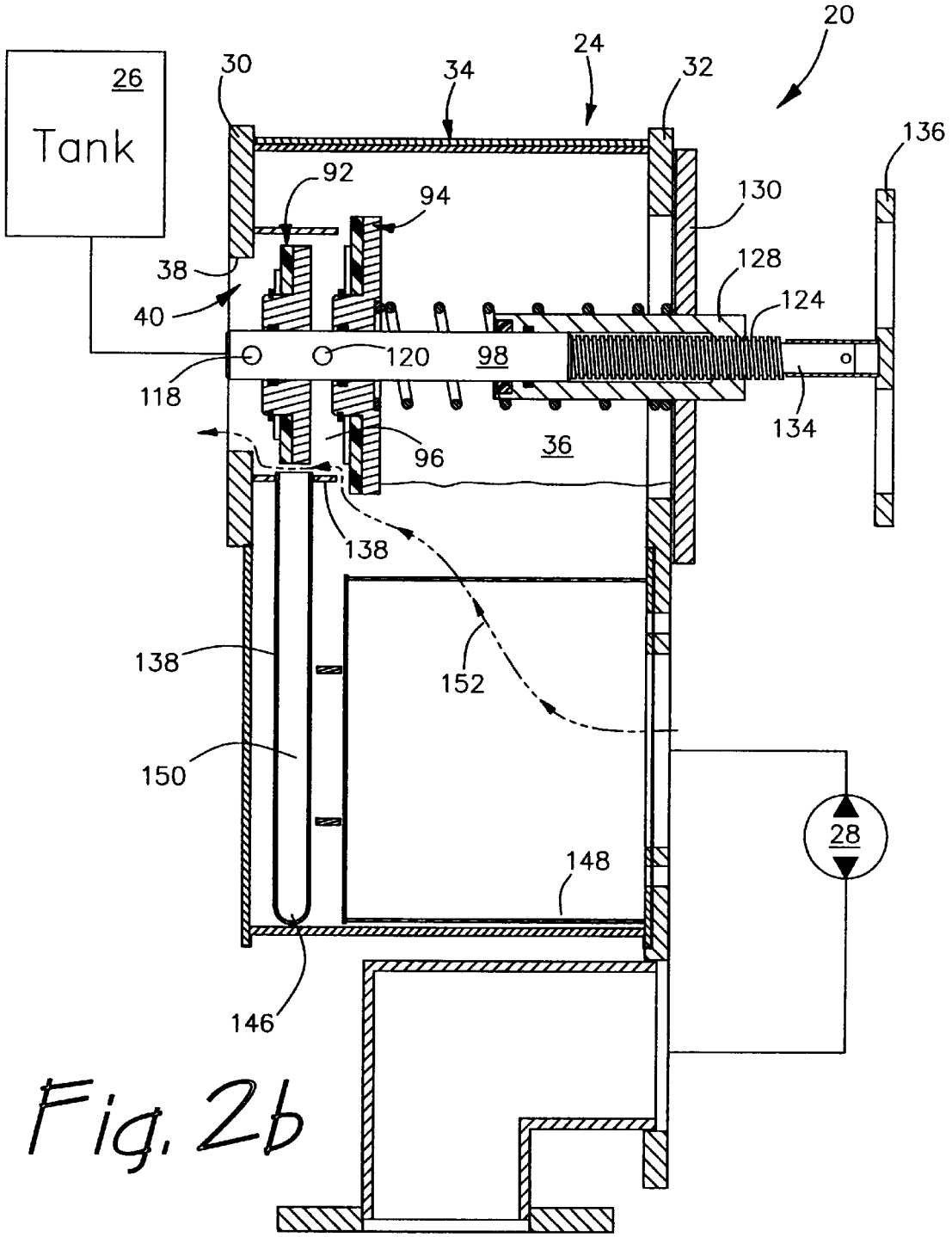
FIG. 2*b* is the same view of FIG. 2 but with the valve assembly in a second alternate position.

During normal spraying mode, both valve members 92, 94 are in the open position shown in FIG. 2*b* and the pump 28 is in the forward mode to pump asphalt from the tank 26 to the spraybar (not shown). After completion of spraying operations, the pump 28 is operated in reverse or "suckback mode" to suck asphalt from the spray bar (not shown) back through the outlet 44 and inlet 40, and into the tank 26 as shown in FIG. 2*b*, with flow arrows 152 indicating the flow path of asphalt. After most of the asphalt is sucked back, a relatively large quantity of asphalt remains in the filtering chamber 36 as the outlet 44 is disposed vertically below the inlet 40. To remove the remaining asphalt, the larger valve member 94 is closed to seal off the windage flow path 152 to the tank 26 as shown in FIG. 2*a*. As the pump 28 continues to run, the pump or other means creates pressure in the filtering chamber 36 to force asphalt through the suckback tube along the flow passage 150 and back through the inlet 40 to the tank 26 with flow arrows 154 indicating the flow path of asphalt. After substantially all of the asphalt is drained from the filtering chamber 36, the smaller valve member 92 can be closed to create a positive seal between the strainer 20 and the tank 26 as shown in FIG. 2. The smaller valve member 92 or other means effectively closes off the flow passage 150 to the tank to prevent asphalt from seeping from the tank 26 into the filtering chamber 36. After the smaller member 92 is closed, flushing solvent can be introduced into the strainer 20 and distributor through the hose barb and valve assembly 72 to flush any residual asphalt remaining in the strainer 20 and plumbing network downstream from the strainer 20.

What is claimed is:

1. An asphalt strainer in an asphalt distributor, the asphalt distributor including a tank and a bidirectional pump, comprising:

a body having an inlet, an outlet, and a filtering chamber, the filtering chamber disposed intermediate the inlet and the outlet, the inlet in fluid communication with the tank, the outlet in fluid communication with the pump, the inlet disposed vertically above the outlet;

a screening element disposed in filtering chamber for filtering asphalt flowing between the inlet and the outlet;

a valve connected to the inlet and having open and closed positions correspondingly connecting and disconnecting the inlet to the filtering chamber;

a suckback tube connected to the inlet and extending into the filtering chamber providing a flow passage from the filtering chamber to the tank, the flow passage bypassing the valve; and means for selectively closing the flow passage.

2. The asphalt strainer of claim 1 wherein said closing means is a second valve disposed intermediate the suckback tube and the tank.

3. The asphalt strainer of claim 1 wherein the body further includes a loading input for tank filling operations, the loading input disposed vertically below the inlet.

4. The asphalt strainer of claim 1 wherein the body defines a bottom surface which is at the gravitational bottom of said filtering chamber, the suckback tube having an open end in close proximity to the bottom surface.

5. The asphalt strainer of claim 1 further comprising a conduit joined to the body and extending the inlet into the filtering chamber, the conduit having an open end inside the body, the valve connected to the open end, and further comprising a second valve inside to the conduit, the conduit defining a suckback chamber between the valves, the second valve having open and closed positions for selectively connecting the suckback chamber to the outside of the body, the suckback tube secured to the conduit with the flow passage in fluid communication with the suckback chamber.

6. The asphalt strainer of claim 5 further comprising a single control connected to the first and second valves for selectively operating both of the valves.

7. An asphalt strainer in an asphalt distributor, the asphalt distributor including a tank and a bidirectional pump, comprising:

a body having an inlet, an outlet and a filtering chamber, the filtering chamber disposed intermediate the inlet and the outlet, the inlet in fluid communication with the tank and the outlet in fluid communication with the pump, the inlet disposed vertically above the outlet;

a screening element disposed in filtering chamber for filtering asphalt flowing between the inlet and the outlet;

a conduit having first and second ends, the first end connected to the body at the inlet, the second end disposed in the filtering chamber to extend the inlet into filtering chamber, the conduit defining a suckback chamber;

a first valve at the first end having open and closed positions for connecting and disconnecting the suckback chamber to the tank, a second valve at the second end having open and closed positions for connecting and disconnecting the suckback chamber to the filtering chamber; and a suckback tube connected to the conduit and extending into the filtering chamber to provide a flow passage from the filtering chamber to the suckback chamber.

8. The asphalt strainer of claim 7 further comprising a single control operable to selectively control the positions of the first and second valves, the single control having a first position in which the first and second valves are closed, a second position in which the first valve is open and the second valve is closed and a third position in which the first and second valves are open.

9. The asphalt strainer of claim 8 wherein the first valve is disposed inside the conduit and selectively forms a first seal against the body and wherein the second valve is disposed inside the filtering chamber and selectively forms a second seal against the conduit.

10. The asphalt strainer of claim 9 wherein the single control comprises a partially threaded shaft, a manually operated wheel and a spring, and wherein the body defines a threaded opening, the shaft slidably disposed the opening with the threads of the opening and shaft intermitting whereby rotation of the shaft linearly translates the shaft relative to the body, the wheel coupled to the shaft outside the body for controlling the linear position of the shaft, the first and second valves being axially spaced and slidably carried on the shaft, the spring coaxially disposed over the shaft and compressed between the second valve and the body, the shaft having a pair of radially extending members, one on each side of the first valve for selectively engaging the first and second valves.

11. The asphalt strainer of claim 7 wherein the suckback tube and conduit are housed entirely within the body to prevent freezing of asphalt in the suckback tube during operation of the asphalt distributor.

12. The asphalt strainer of claim 7 wherein the body defines a bottom surface which is at the gravitational bottom of said filtering chamber, the suckback tube having an open end in close proximity to the bottom surface.

13. The asphalt strainer of claim 7 wherein the bidirectional pump has forward and suckback modes, asphalt flowing from the inlet to the outlet in the forward mode, asphalt flowing from the outlet to the inlet in the suckback mode, asphalt flowing from the outlet through the second end and the conduit to the inlet when the first and second valves are open, asphalt flowing from the outlet through the suckback tube and to inlet when the second valve is closed and the first valve is open.

14. The asphalt strainer of claim 13 wherein the body further has a loading input for tank filling operations, the loading input disposed vertically below the inlet and including a quick disconnect coupling for selective connection to external supply lines.

15. A method of draining residual asphalt in an asphalt strainer of an asphalt distributor, the asphalt distributor including a bidirectional pump, a tank and a spray bar, the pump having forward and reverse modes, the pump pumping asphalt from the tank to the spray bar during the forward mode and sucking asphalt from the spray bar to the tank during the reverse mode, the strainer having an inlet, an outlet, a filtering chamber, and a screening element in the filtering chamber, the inlet connected to the tank, the outlet connected to the pump, the method comprising the steps of:

operating the pump in the reverse mode;

directing asphalt through the strainer along a first flow passage from the outlet to the inlet;

closing a valve disposed in the first flow passage to thereby stop asphalt flow through the first flow passage; and draining asphalt remaining in the filtering chamber through a suckback tube internal to the strainer, the suckback tube providing a second flow passage from the filtering chamber to the inlet.

16. The method of claim 15 further comprising the steps of:

closing a valve disposed along the second flow passage to thereby stop asphalt flow through the suckback tube; and stopping the reverse mode of the pump.

17. The method of claim 15 wherein the strainer has a bottom surface which is at the gravitational bottom of the filtering chamber and wherein the suckback tube has an open end in close proximity to the bottom surface.

18. The method of claim 15 further comprising selectively flowing asphalt into the strainer and through the outlet through a tank loading input in the strainer.

19. An asphalt strainer in an asphalt distributor, the asphalt distributor including a tank and a bidirectional pump, comprising:

a body having an inlet, an outlet, and a filtering chamber, the filtering chamber disposed intermediate the inlet and the outlet, the inlet in fluid communication with the tank, the outlet in fluid communication with the pump, the inlet disposed vertically above the outlet;

a screening element disposed in filtering chamber for filtering asphalt flowing between the inlet and the outlet;

a valve assembly interposed between said inlet and outlet having a first position providing first passageway between the inlet and the outlet, a second position providing a second passageway between the inlet and the outlet, and a third position in which the first and second passageways are closed;

a suckback tube in the filtering chamber providing said first passageway; and means for controlling the position of the valve assembly.

20. The asphalt strainer of claim 19 wherein the valve assembly comprises first and second valve members having open and closed positions.

21. The asphalt strainer of claim 20 where said control means comprises a single movable member operable to position both of the first and second valve members.

22. The asphalt strainer of claim 19 further comprising a suckback conduit extending the inlet into the filtering chamber, the suckback tube connected to the suckback conduit.

23. The method of claim 19 wherein the strainer has a bottom surface which is at the gravitational bottom of the filtering chamber and wherein the suckback tube has an open end in close proximity to the bottom surface.

* * * * *